US005465903A

United States Patent [19]

Davis et al.

[11] Patent Number: 5,465,903

[45] Date of Patent: Nov. 14, 1995

[54] MOUNTING PLATE FOR FIXING ELASTOMERIC GRADE CROSSING PANELS TO TIES

[75] Inventors: R. Andrew Davis, Lake Oswego; Rolf Heineman, Portland, both of Oreg.

[73] Assignee: Riedel Omni Rubber Products, Inc., Portland, Oreg.

[21] Appl. No.: 829,709

[22] Filed: Feb. 3, 1992

[51] Int. Cl.[6] ..... E01B 21/00

[52] U.S. Cl. ..... 238/8; 404/41

[58] Field of Search ..... 238/2, 8, 6, 9; 404/34, 41

[56] References Cited

U.S. PATENT DOCUMENTS

| | | | |
|---|---|---|---|
| 1,548,057 | 8/1925 | Mulvihill | 238/8 |
| 1,725,411 | 8/1929 | Muchnic | 238/8 |
| 2,017,336 | 10/1935 | Alexander | 238/8 |
| 2,984,417 | 5/1961 | Voorhees | 238/8 |
| 3,861,591 | 1/1975 | Rector | 238/8 |
| 4,093,120 | 6/1978 | Confield | 238/8 |
| 4,176,789 | 12/1979 | Rich | 238/8 |
| 4,253,605 | 3/1981 | Sims | 238/8 |
| 4,365,743 | 12/1982 | Trickel et al. | 238/8 |
| 4,368,845 | 1/1983 | Perry et al. | 238/8 |

*Primary Examiner*—Michael S. Huppert
*Assistant Examiner*—Scott L. Lowe
*Attorney, Agent, or Firm*—Chernoff, Vilhauer, et al.

[57] ABSTRACT

A railroad grade crossing system comprises a plurality of plates that rest on selected ties. The plates have two or more upstanding projections with threaded openings extending through them. The plates are positioned at the intersections of adjacent elastomeric grade crossing panels that have recesses defined in their lower surfaces that receive the projections. Bores extending through the panels coaxially with the recesses permit bolts to be installed through the panels into threaded engagement with the projections. Since adjacent panels are attached to a common plate, they become interconnected so that the weight of an entire crossing element will resist movement of the panels. In a typical application there are three crossing elements; a gauge element between the rails, and a field crossing element between each rail and the adjacent roadway. Typically, the gauge panels only extend half-way between the rails so that each gauge plate is coupled to the inner corner of four adjacent gauge panels. A locking panel, having wings which fit over the tie, is located at the center of each crossing element to facilitate installation. An end restraint, affixed to a tie at each end of each crossing element, ensures that there is no movement of the crossing element along the rails and prevents lifting of the free end of the terminal crossing panel.

8 Claims, 2 Drawing Sheets

MOUNTING PLATE FOR FIXING ELASTOMERIC GRADE CROSSING PANELS TO TIES

BACKGROUND AND SUMMARY OF THE INVENTION

This invention relates to a system for mounting elastomeric grade crossing panels without the necessity of penetrating the ties that support the panels.

It has become common practice to install elastomeric grade crossing panels between the rails and between the rails and the roadway to form railroad grade crossings. These panels are manufactured in relatively short segments which are placed end to end in order to facilitate their manufacture, transportation and installation. Because of their size and the lightness of the elastomeric material, these panels tend to move along the rails when vehicular traffic crosses them unless they are affixed to the ties. This does not create any problem when the panels are placed on wooden ties since spikes or timber screws can be inserted through openings provided in the panels and driven into the ties. However, it is desirable not to install fasteners in concrete ties since doing so can cause degradation of the concrete, and if the fastener strikes reinforcing bar in the tie it will cause a reduction in the strength of the tie.

In the past elastomeric grade crossing panels have been attached to plates that are joined to the concrete ties by adhesives in order to overcome the foregoing problem. However, adhesives often lose their effectiveness with age and exposure to the elements and as a result the panels become loose. When an adhesive bond does remain intact, it prevents the panels from being easily removed when periodic tamping of the ballast the ties are supported on becomes necessary.

The subject invention overcomes the foregoing problems by attaching each panel to its adjacent panels so that movement of the panels is resisted by their entire weight, thereby making it unnecessary to mechanically affix the panels to the ties. This is accomplished by providing a plurality of plates that rest on the ties beneath the ends of adjacent panels. The plates have upwardly extending projections that fit in recesses located in the bottoms of the panels, with each plate having projections that engage the recesses in two or more panels. The projections have threaded openings extending through them and the panels have bores aligned with the recesses through which bolts can be inserted and engaged in the threaded openings. The panels are secured to the plates, and thus to one another, by tightening the bolts. In a preferred embodiment of the invention at least one of the plates is a locking plate which has wings that fit over the sides of the tie. Thus, the locking plate is restrained against lateral displacement on the tie.

The gauge panels, which fit between the rails, preferably only extend half-way between the rails in order to simplify installation. Thus, the gauge panels have inner corners which abut the inner corners of three other gauge panels. The gauge plate, which interconnects these gauge panels, fits under the four adjacent inner corners and has four projections, one of which engages each of the panels.

The field panels, which fit between the rails and the roadway, generally are full width and thus field plates normally only have two projections.

End restraints can be provided in order to ensure that the panels do not move longitudinally along the rails and that the exposed ends of the terminal panels do not lift. Each end restraint includes a base element that fits over and around an associated end tie and a contact element that attaches to the base element and abuts the outer end of the terminal panel. Timber screws extend through the end plate into the terminal panel.

Accordingly, it is a principal object of the subject invention to provide a railroad grade crossing in which elastomeric crossing panels can be mounted immovably without having to penetrate the ties.

It is a further object of the subject invention to provide such a grade crossing in which individual panels can be easily removed and reinstalled to facilitate retamping the ballast in the railroad bed.

It is a still further object of the subject invention to provide such a grade crossing in which adjacent panels are attached to one another so that the entire weight of the crossing elements resist movement of the panels.

It is a still further object of the subject invention to provide such a railroad grade crossing in which the panels can be quickly and easily installed.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
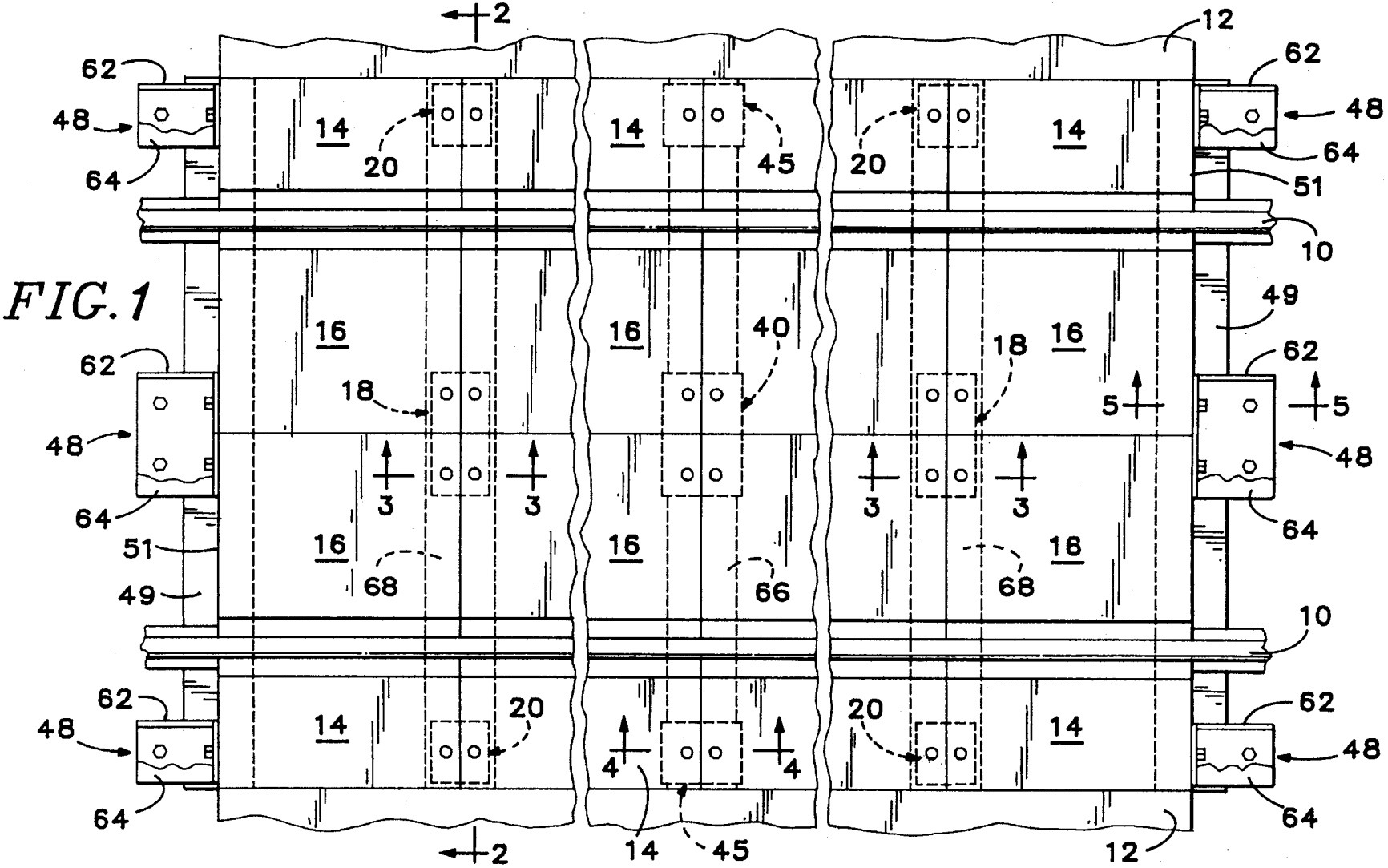
FIG. 1 is a fragmentary, foreshortened plan view of a railroad grade crossing, embodying the system of the subject invention.
Figure 2:
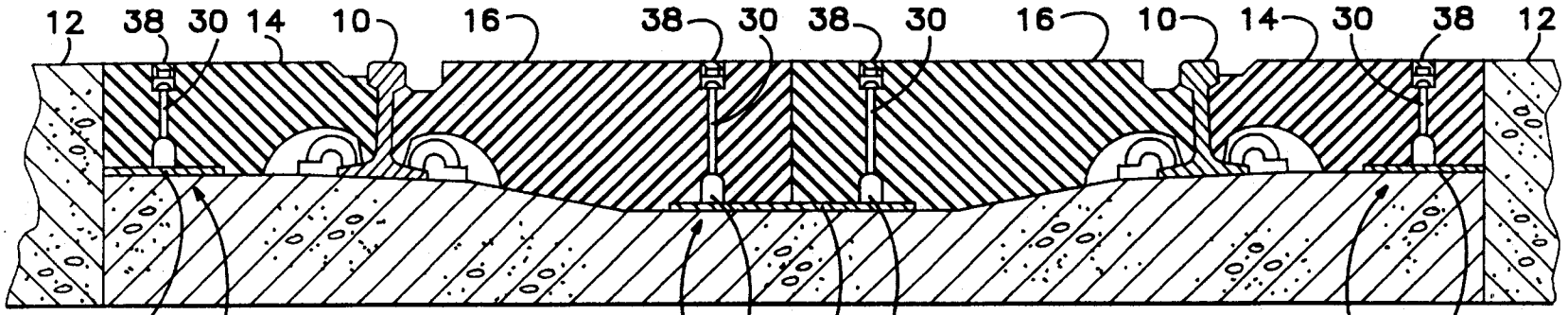
FIG. 2 is a sectional view, at an enlarged scale, taken along the line 2—2 in FIG. 2.

Referring to FIGS. 1 and 2 of the drawings, a railroad grade crossing extends across a pair of parallel rails 10 between a roadway 12 on each side of the rails. The crossing comprises a plurality of elastomeric panels similar to those described in Trickel et al. U.S. Pat. No. 4,365,743. Field panels 14 fit between each rail 10 and the adjacent roadway 12 and gauge panels 16 fit between the rails. The panels are considerably shorter than the length of the crossing, thereby requiring that several panels be positioned end to end. In the embodiment illustrated, the gauge panels 16 only extend across one-half of the distance between rails thereby requiring the gauge panels to be placed in side-by-side pairs. When installed, each pair of gauge panels generally extends from rail to rail and each field panel extends from rail to roadway. Thus, the panels are restrained against lateral movement by the rails and the roadway. This rail-to-rail and rail-to-roadway contact along with the weight of the panels also prevents vertical movement of the panels when vehicular traffic crosses over them, but the individual panels are not heavy enough to remain longitudinally stable over an extended period of use. Thus, mounting plates are used to connect adjacent panels together to form unitized crossing elements which are heavy enough to resist longitudinal movement when driven across.

Figure 6:
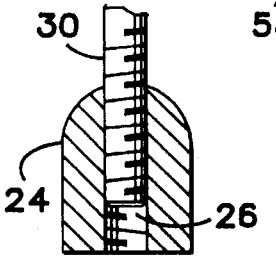
FIG. 6 is a fragmentary side elevation view in cross section of a portion of a plate that constitutes an element of the invention.
Figure 4:
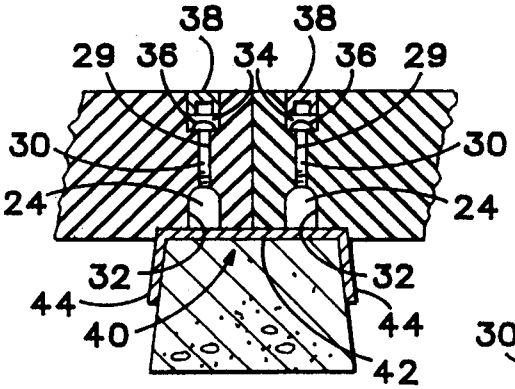
FIG. 4 is a sectional view, at an enlarged scale, taken along the line 4—4 in FIG. 1.
Figure 3:
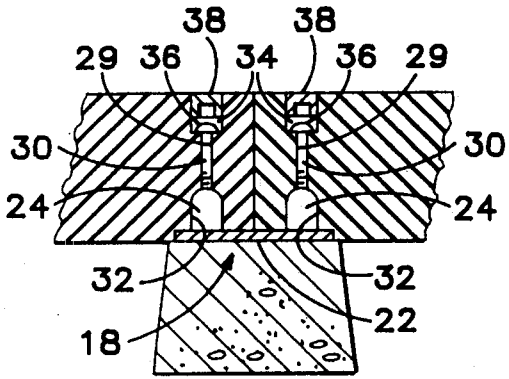
FIG. 3 is a sectional view, at an enlarged scale, taken along the line 3—3 in FIG. 1.

The mounting plates include gauge plates 18 which interconnect both side-by-side pairs and adjacent end-to-end gauge panels, and field plates 20 which interconnect end-to-end field panels. Referring now also to FIG. 3, each gauge plate 18 includes a flat base 22 that rests on top of a tie intermediate the rails. Located at each corner of the base 22 is a hollow, upwardly projecting protrusion 24, FIG. 6, that has a threaded opening 26 extending through it. Each gauge panel has a bore 29 extending through each inner corner, with the bores ia the four adjacent panels being aligned with the four projections in the gauge plate when the gauge plate is centered under the intersection of the four panels. The bore is sized to loosely receive a bolt 30 that fits in the threaded opening 26, and has an elongated recess 32 at its lower end that snugly receives one of the protrusions 24. A counterbore 34, located at the top of each bore, receives the head 36 of the bolt 30 below the upper surface of the panel. An elastomeric plug 38 fits in the counterbore above the bolt after assembly to seal the bore and provide a continuous roadway surface. One gauge plate in each crossing is a locking gauge plate 40, FIG. 4. The base 42 of the locking plate extends over the edges of the tie and wings 44 extend downwardly from the base over the sides of the tie. Thus, the locking gauge plate cannot be moved laterally with respect to the tie once it is installed. The remainder of the locking gauge plate is identical to the regular gauge plate 18. Preferably a locking gauge plate is placed at the center of the crossing.

Each field plate 20 includes a planar base 44 that is approximately one-half the size of the gauge plate base 22. Since the field panels 14 extend completely across the space between the rail and the roadway, the field plate only joins end-to-end panels and thus only has two protrusions 24 rather than four. Otherwise, the field plate is the same as the gauge plate. As with the gauge plate, a locking field plate 45 having depending wings 44, is provided at the center of each field crossing element.

Figure 5:
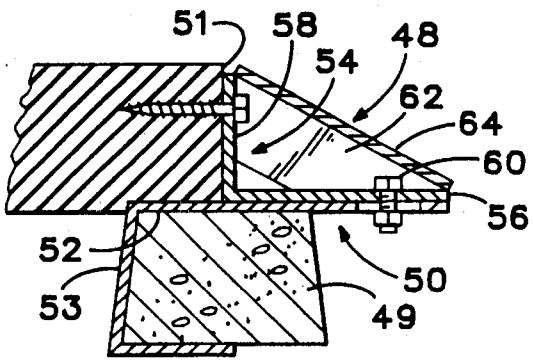
FIG. 5 is a sectional view, at an enlarged scale, taken along the line 5—5 in FIG. 1.

Even though the weight of the interconnecting crossing elements is large enough to prevent movement along the rails, in the preferred embodiment of the invention illustrated, end restraints 48, FIG. 5, are placed at the outer ends of the terminal field and gauge panels to prevent gradual movement of the panels causing them to become misaligned over a period of time. Each end restraint is attached to the end tie 49 that is located under the outside ends 51 of the terminal panels. Referring to FIG. 5, each end restraint comprises a base element 50 having a plate 52 that fits on top of the tie and an L-shaped leg 53 that fits behind and under the end tie. An L-shaped contact element 54 has a horizontal leg 56 that attaches to the base element 50, and an upright leg 58 that abuts the outside end 51 of the terminal panel. The contact element 54 is attached to the plate 52 by nuts and bolts 60 that fit through slots in the plate 52 and leg 56. Thus, the location of the contact element can be adjusted so that the upright leg 58 abuts the outside end 51 of the terminal panel. After the end restraint is in place a timber screw is placed through the upright leg 58 into the panel to prevent lifting of the otherwise free end of the terminal panel. Gussets 62 extend between the horizontal and upright legs to stiffen the contact element 54, and a deflector plate 64 is attached to the gussets to provide a cover.

The system of the subject invention is installed by first placing a locking gauge plate 40 at the center of the tie 66 located closest to the middle of the crossing. Regular gauge plates 18 are placed in the centers of the remaining ties 68 that will be between adjacent gauge panels 16, i.e., at spacings equal to the length of the gauge panels. The first gauge panel is then placed on the locking gauge plate and the adjacent gauge plate with the recesses 32 in the panel fitting over the protrusions 24. Bolts 30 are installed through the bores 29 into threaded engagement with the threaded openings 26 in the protrusions 24. It is important that each bore 29 be aligned with the opening 26 in the associated protrusion 24 to prevent cross-threading. A flashlight or a mirror (to reflect the sun) is useful for this purpose. A flat washer and lock washer (not shown) preferably is placed over each bolt before it is installed. The bolts are not tightened, however, until all four adjoining panels that are interconnected by a common plate have been installed. The opposed side-by-side gauge panel is then installed by inserting its outer edge against the rail 10 and forcing its inner edge over the previously installed gauge panel. The remaining gauge panels are installed in a like manner.

The bottoms of the panels are contoured to contact the ties over their full width which causes the panel to be supported by the ballast (not shown) in the crib area between the ties. In addition, the bottom of the inner corners of each panel is relieved to receive the base 42 of the plate 18.

Before the terminal gauge panels are installed the base elements 50 of the end restraints 48 are installed on the end ties 49 at each end of the crossing. This will require removal of ballast, and possibly a hydraulic jack will be required to completely seat the bases against the ties. In addition it may be necessary to move the end ties in order that the contact elements 54 are in engagement with the outside ends 51 of the terminal panels. After the base elements are installed the contact elements 54 are attached to them in a manner such that their upright legs 58 contact the outside ends 51 of the panels.

The field panels are then installed in the same manner working from the locking field plate 45 at the center of the crossing.

Once the panels are installed the crossing elements are held firmly in place without the necessity of penetrating the ties or the use of adhesives, which permits removal of the crossing elements for retamping of the ballast.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A system for mounting a railroad grade crossing, of the type where a plurality of side-by-side elastomeric field panels are located between each rail and the edge of the roadway that crosses the rails and a plurality of side-by-side elastomeric gauge panels are located between the rails, without penetrating the ties that support the rails, said panels having a lower surface that rests on the ties and an upper surface that supports vehicles passing over the grade crossing, said system comprising:

(a) a plurality of plates that rest on selected ties and have upwardly-extending projections;

(b) means associated with said projections for threadedly receiving bolts;

(c) the panels having openings extending therethrough, the portions of said openings adjacent to the lower surfaces of the panels defining recesses that matingly receive said projections, and the portions of said openings adjacent to the upper surfaces of the panels defining counterbores;

(d) bolts that extend through said openings into threaded engagement with said engagement means in said projections, said bolts having heads that fit within said counterbores below said upper surfaces of the panels; wherein (e) each of said plates contains projections that mate with recesses in two or more side-by-side panels.

2. The system of claim 1 wherein said gauge panels are arranged in opposed pairs with one panel in each pair extending from approximately midway between the rails into abutment with each rail, and said plates comprise gauge plates, wherein:

(a) said gauge plates have four projections;

(b) each of said gauge panels have at least one inner corner which abuts the inner corner of its opposed pair and abuts the inner corners of an adjacent pair of gauge panels;

(c) each of said gauge panels has an opening defined in said inner corner; and (d) said projections are arranged on said gauge plates to simultaneously engage said openings in four gauge panels having adjacent inner corners.

3. The system of claim 1 wherein said plates comprise field plates, wherein:

(a) said field plates have two projections;

(b) each of said field panels has at least one side edge which abuts the side edge of an adjacent field panel;

(c) each of said field panels has an edge opening defined adjacent to each said side edge; and (d) said projections are arranged on said field panels to simultaneously engage said edge openings in two field panels having adjacent edges.

4. The system of claim 1 wherein at least one of said plates associated with the gauge panels and at least one of said plates associated with the field panels on each side of the rails is a locking plate and includes locking means for engaging the tie and preventing movement of said locking plate laterally on said tie.

5. The system of claim 4 wherein said locking means comprises wings which extend downwardly from said locking plates and engage the sides of said rails.

6. The system of claim 1 including end restraint means associated with terminal field and gauge panels located at the extremities of the crossing, for preventing movement of the panels along the rails.

7. The system of claim 6 wherein said terminal field and gauge panels have outside ends, an end tie, located adjacent to said outside ends, has an inner side, and said end restraint is attached to said end tie.

8. The system of claim 7 wherein said end restraint comprises:

(a) a base element having a plate that overlies said end tie, and an L-shaped leg that wraps around said inner side; and (b) a contact element which is attached to said plate and engages the outside end of the panels.

* * * * *